US008905150B1

(12) United States Patent
Pruitt et al.

(10) Patent No.: US 8,905,150 B1
(45) Date of Patent: Dec. 9, 2014

(54) CASING STRIPPER ATTACHMENT

(75) Inventors: Grant Pruitt, Fort Smith, AR (US); Cris Braun, Van Buren, AR (US)

(73) Assignee: Pruitt Tool & Supply Co., Fort Smith, AR (US)

( * ) Notice: Subject to any disclaimer, the term of this patent is extended or adjusted under 35 U.S.C. 154(b) by 503 days.

(21) Appl. No.: 13/199,197

(22) Filed: Aug. 22, 2011

(51) Int. Cl.
*E21B 33/08* (2006.01)

(52) U.S. Cl.
USPC ..... 166/387; 166/84.1; 175/209

(58) Field of Classification Search
CPC ..... E21B 33/085
USPC ..... 166/387, 84.1, 85.3, 379, 82.1; 175/84, 175/209, 214; 27/322, 323, 326, 329, 343, 27/575, 602, 616, 626, 630, 637, 640; 277/322, 323, 326, 329, 343, 575, 602, 277/616, 626, 630, 637, 640
See application file for complete search history.

(56) References Cited

U.S. PATENT DOCUMENTS

| | | | | | |
|---|---|---|---|---|---|
| 25,283 | A | | 8/1859 | Smith | 285/360 |
| 1,157,644 | A | | 10/1915 | London | |
| 1,858,352 | A | * | 5/1932 | Young | 251/1.1 |
| 2,885,583 | A | | 5/1959 | Zunick et al. | |
| 3,061,387 | A | | 10/1962 | Laws | 308/187 |
| 3,285,352 | A | * | 11/1966 | Hunter | 175/214 |
| 3,387,851 | A | | 6/1968 | Cugini | |
| 3,400,938 | A | | 9/1968 | Williams | 277/31 |
| 3,934,887 | A | * | 1/1976 | Biffle | 166/84.3 |
| 3,992,019 | A | | 11/1976 | Crawshay | 279/4 |
| 4,029,368 | A | | 6/1977 | Tschirky et al. | |
| 4,037,890 | A | | 7/1977 | Kurita et al. | 308/187 |
| 4,138,148 | A | | 2/1979 | Zaremba | 285/317 |
| 4,185,856 | A | | 1/1980 | McCaskill | 285/18 |
| 4,208,056 | A | | 6/1980 | Biffle | 277/31 |
| 4,363,357 | A | * | 12/1982 | Hunter | 166/84.3 |
| 4,466,551 | A | | 8/1984 | Leung | 220/293 |
| 4,486,025 | A | * | 12/1984 | Johnston | 277/343 |
| 4,511,193 | A | | 4/1985 | Geczy | 384/611 |
| 4,531,766 | A | | 7/1985 | Crase | 285/18 |
| 4,620,730 | A | | 11/1986 | Larsen | 285/166 |
| 4,690,213 | A | | 9/1987 | Stannard et al. | 166/84 |
| 4,856,827 | A | | 8/1989 | Delamare | 285/268 |
| 4,949,796 | A | * | 8/1990 | Williams | 175/209 |
| 5,028,181 | A | | 7/1991 | Jenkins et al. | 409/215 |
| 5,062,479 | A | | 11/1991 | Bailey et al. | 166/84 |
| 5,101,896 | A | | 4/1992 | Thompson | 166/90 |
| 5,170,853 | A | | 12/1992 | Mason et al. | 175/84 |
| 5,180,261 | A | | 1/1993 | Schreiber | 408/239 |
| 5,213,158 | A | | 5/1993 | Bailey et al. | 166/85 |
| 5,452,771 | A | | 9/1995 | Blackman et al. | 175/353 |
| 5,482,331 | A | | 1/1996 | Shore | 285/214 |

(Continued)

*Primary Examiner* — Jennifer H Gay
*Assistant Examiner* — George Gray
(74) *Attorney, Agent, or Firm* — Stephen D. Schrantz; Schrantz Law Firm, PLLC

(57) ABSTRACT

The casing stripper attachment secures the casing stripper within a housing, such as the bowl. The casing stripper rubber attaches to an attachment body for installation within the housing. The attachment body includes a base and an attachment lip. The base provides an outer surface for securing the attachment body and stripper rubber to the housing. The clamp secures the outer surface of the base with the housing. The stripper rubber fastens to the attachment lip of the attachment body to be secured within the bowl. The base of the present invention could attach to a drilling nipple that assists with inserting the casing into the well, a process known as running casing.

4 Claims, 5 Drawing Sheets

(56) References Cited

U.S. PATENT DOCUMENTS

| | | | | |
|---|---|---|---|---|
| 5,647,444 | A | 7/1997 | Williams | 175/209 |
| 5,662,171 | A | 9/1997 | Brugman et al. | 166/383 |
| 5,662,181 | A | 9/1997 | Williams et al. | 175/195 |
| 5,842,252 | A | 12/1998 | Cameron et al. | 15/256.5 |
| 6,033,117 | A | 3/2000 | Cariveau et al. | 384/94 |
| 6,155,388 | A | 12/2000 | Sandmann | 188/226.1 |
| 6,305,483 | B1 | 10/2001 | Portwood | 175/371 |
| 6,457,749 | B1 | 10/2002 | Heijnen | 285/307 |
| 6,929,076 | B2 | 8/2005 | Fanuel et al. | 175/267 |
| 7,004,266 | B2 | 2/2006 | Russell et al. | 175/321 |
| 7,152,509 | B2 | 12/2006 | McCalley, Jr. et al. | 81/53.2 |
| 7,198,098 | B2 | 4/2007 | Williams | 166/84.3 |
| 7,380,591 | B2 | 6/2008 | Williams | 166/84.3 |
| 7,380,610 | B2 | 6/2008 | Williams | 166/387 |
| 7,416,021 | B2 | 8/2008 | Williams | 166/84.1 |
| 7,621,344 | B2 | 11/2009 | Frey | 175/84 |
| 7,717,168 | B2 | 5/2010 | Williams | 166/84 |
| 7,717,170 | B2 | 5/2010 | Williams | 166/84.3 |
| 7,789,132 | B2 | 9/2010 | Williams | 166/84.1 |
| 7,798,210 | B1 | 9/2010 | Pruitt et al. | 166/84.3 |
| 7,836,946 | B2 | 11/2010 | Bailey et al. | 166/84.2 |
| 7,870,896 | B1 | 1/2011 | Pruitt et al. | 166/84.3 |
| 2004/0250766 | A1 | 12/2004 | Fink | 118/715 |
| 2005/0252692 | A1 | 11/2005 | Liu et al. | 175/31 |
| 2005/0252694 | A1 | 11/2005 | Kennedy | 175/376 |
| 2006/0049587 | A1 | 3/2006 | Cornwell | 279/75 |
| 2007/0151725 | A1 | 7/2007 | Cook et al. | |
| 2007/0262582 | A1* | 11/2007 | Williams | 285/404 |
| 2009/0057024 | A1 | 3/2009 | Williams | |
| 2009/0057027 | A1 | 3/2009 | Williams | 175/195 |
| 2013/0233556 | A1* | 9/2013 | Boyd | 166/302 |

* cited by examiner

CASING STRIPPER ATTACHMENT

CROSS-REFERENCE TO RELATED APPLICATIONS

This application is being filed on Aug. 22, 2011 on the same date that another application entitled "PIPE WIPER BOX" to Grant Pruitt and Cris Braun is being filed and the same date that another application entitled "ADAPTER ASSEMBLY" to Grant Pruitt and Cris Braun is being filed.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

Oil, gas, water and geothermal wells are typically drilled with a drill bit connected to a hollow drill string which is inserted into a well casing cemented in the well bore. A drilling head is attached to the well casing, wellhead or to an associated blowout preventer to seal the interior of the well bore from the surface. The drilling head also facilitates forced circulation of drilling fluid through the well while drilling or diverting drilling fluids away from the well. Drilling fluids include, but are not limited to, water, steam, drilling muds, air, and other gases.

Such drilling fluids should remain within the well. Spillage of the drilling fluids inconvenience workers and costs money and time. Furthermore, the stripper rubber connection should be made quickly and achieve a fluid tight seal.

However, casing typically includes various diameter sections. Thus, the rubber was sized to maintain sealing contact with the casing or the smallest diameter component which traveled through the well. The rubber must be rigid enough to withstand the pressures of the drilling fluid yet resilient enough to maintain a seal on the casing and other tools as the casing and other tools pass through the well.

Present day drilling operations are extremely expensive, and an effort to increase the overall efficiency of the drilling operation while minimizing expense requires the essentially continuous operation of the drilling rig. Thus, it is imperative that downtime be minimized.

In this regard, there is a need for improved sealing of the casing and allowing different sized casing and other tools through the casing stripper.

Pressure control is achieved by means of one or more stripper rubbers. Stripper rubbers typically taper downward and include rubber or other elastomeric substrate so that the downhole pressure pushes up on the rubber, pressing the rubber against the casing inserted into the stripper rubber to achieve a fluid-tight seal.

Casing stripper rubbers are connected or adapted to the drilling nipple at the nipple base to establish and maintain the pressure control seal around a down hole tubular (i.e. casing, etc.). The casing striper rubber replaces the bearing assembly when running casing and is especially useful in containing cement or drilling fluid returning to the surface. Casing stripper rubber sizes usually vary from 4½ inches to 13⅜ inches oversized.

Known casing stripper rubbers attach via a threaded connection to the drilling nipple. The threaded connection requires a specialized casing stripper rubber with internal threads. These specialized strippers can only be attached to threaded connections. Such threaded connections create difficulties when attaching and removing the casing stripper rubber. Dirt and other debris found on the drilling nipple increase the difficulty of attaching the casing stripper rubber to the drilling nipple. After use of the casing stripper rubber, users must remove the casing stripper rubber from the drilling nipple. The threaded connection of the casing stripper rubber increases the difficulty of removing the casing stripper rubber from the drilling nipple. In most instances, users cannot remove the casing stripper rubber from the drilling nipple. Users must either cut the casing stripper rubber from the drilling nipple or otherwise destroy the casing stripper rubber to remove the casing stripper rubber.

Cutting and otherwise destroying the casing stripper rubber requires additional time and effort for removing the casing stripper rubber. The casing stripper rubber attachment of the present invention improves the speed and efficiency of attaching and removing the casing stripper rubber. The improved efficiency of attaching and removing the casing stripper rubber decreases the drilling costs by reducing downtime of the operation. Furthermore, the present invention reduces the costs of manufacturing the casing stripper rubber. Furthermore, the casing stripper rubber of the present invention provides a greener solution than the known art. The casing stripper rubber of the present invention reduces the harmful environmental effects of removing the known casing stripper rubbers.

Therefore, a casing stripper rubber assembly that overcomes abovementioned and other known and yet to be discovered drawbacks associated with known casing stripper rubber assemblies individually and, optionally, would be advantageous, desirable and useful.

2. Description of the Known Art

Patents and patent applications disclosing relevant information are disclosed below. These patents and patent applications are hereby expressly incorporated by reference in their entirety.

U.S. Pat. No. 7,717,168 ("the '168 patent") issued to Williams et al. on May 18, 2010 teaches a reinforced stripper rubber assembly with a stripper rubber body including a drillstring engaging portion having a drillstring bore extending axially therethrough. The drillstring engaging portion of the stripper rubber body taught by the '168 patent is made from an elastomeric material, has an inner surface that engages a drillstring when the drillstring is disposed therein and has a reinforcing insert receiving recess within an exterior surface thereof extending at least partially around the drillstring bore. The '168 patent teaches that a reinforcing insert is disposed within the reinforcing insert receiving recess. The reinforcing insert taught by the '168 patent includes an elastomeric material bonded to the stripper rubber body within the reinforcing insert receiving recess. A support structure taught by the '168 patent is disposed within a support structure engaging portion of the stripper rubber body. The support structure taught by the '168 patent includes a central opening generally aligned with the drillstring bore thereby allowing the drillstring to pass jointly through the central opening and the drillstring bore.

U.S. Pat. No. 7,717,170 ("the '170 patent") issued to Williams on May 18, 2010 teaches an upper stripper rubber canister system comprising a canister body and a canister body lid. The canister body taught by the '170 patent includes an upper end portion, a lower end portion and a central passage extending therebetween. The central passage taught by the '170 patent is configured for having a stripper rubber assembly disposed therein. The upper end portion of the body includes a plurality of bayonet connector structures. The canister body lid taught by the '170 patent includes an exterior surface, an upper end portion, a lower end portion and a central passage extending between the end portions thereof. The '170 patent teaches that the exterior surface is configured for fitting within the central passage of the canister body. The canister body lid taught by the '170 patent includes a plurality of bayonet connector structures integral with its exterior surface. Each canister body lid bayonet connector structure taught by the '170 patent is configured for being engaged with one of the canister body bayonet connector structures for interlocking the canister body lid with the canister body.

U.S. Pat. No. 5,062,479 ("the '479 patent") issued to Bailey, et al. on Nov. 5, 1991 teaches a stripper rubber for use in a drilling head to seal against a work string deployable through the drilling head. The stripper rubber taught by the '479 patent is longitudinally restrained to prevent extrusion of the stripper under pressure and to reduce the tensile and compressive stresses on the stripper rubber. The '479 patent teaches one embodiment of the stripper rubber that incorporates upper and lower metal rings which are maintained in spaced apart relation by vertical rods thereby allowing radial expansion as tool joints pass through the rubber but prevents inversion of the stripper rubber under pressure. The '479 patent teaches a second embodiment that bonds a stripper rubber into a cylinder which restrains the rubber in the vertical direction. Radial deflection is accommodated by allowing the rubber to flow vertically as a tool joint passes therethrough. Each of the stripper rubbers taught by the '479 patent incorporates an integrally formed drive bushing which facilitates mounting within the drilling head.

U.S. Pat. No. 5,213,158 ("the '158 patent") issued to Bailey, et al. on May 25, 1993 teaches a drilling head with dual rotating stripper rubbers designed for high pressure drilling operations ensuring sealing under the extreme conditions of high flow or high pressure wells such as horizontal drilling. The dual stripper rubbers taught by the '158 patent seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

U.S. Pat. No. 5,647,444 issued to Williams on Jul. 15, 1997 ("the '444 patent") discloses a rotating blowout preventor having at least two rotating stripper rubber seals which provide a continuous seal about a drilling string having drilling string components of varying diameter. A stationary bowl taught by the '444 patent is designed to support a blowout preventor bearing assembly and receives a swivel ball that cooperates with the bowl to self-align the blowout preventor bearing assembly and the swivel ball with respect to the fixed bowl. The '444 patent teaches that chilled water is circulated through the seal boxes of the blowout preventor bearing assembly and liquid such as water is pumped into the bearing assembly annulus between the stripper rubbers to offset well pressure on the stripper rubbers.

SUMMARY OF THE INVENTION

The casing stripper rubber of the present invention attaches to an attachment body for installation within a housing such as the bowl. The attachment body includes a base and an attachment lip. The base provides an outer surface for securing the attachment body and stripper rubber to the housing. The clamp secures the base of the attachment body with the housing. The stripper rubber fastens to the attachment lip of the attachment body to be secured within the bowl.

The base of the present invention attaches to a pipe such as a drilling nipple. The height of the pipe extending upwards from the base may vary according to the needs at the well. The drilling nipple assists with inserting the casing into the well, a process known as running casing. The attachment of the casing stripper with the attachment body increases the bore through which the casing and other downhole tools can be inserted. Therefore, larger casing and other downhole tools can be used within the well.

The known art provides a casing stripper rubber that attaches via a threaded connection that is limited in bore size. Therefore, the known art does not allow larger drilling tools, downhole tools, casing, and pipe to pass through the stripper aperture. The known art also increases the difficulty in attaching and removing the casing stripper rubber. The present invention provides a non-threaded connection thus allowing for the casing stripper rubber to be used in different environments. The attachment of the casing stripper rubber to the attachment body taught by the present invention enables a larger bore size and stripper aperture. The larger stripper aperture of the present invention allows larger size drilling tools, downhole tools, and casing to pass through the stripper aperture of the present invention.

It is an object of the present invention to provide an improved casing stripper rubber.

It is another object of the present invention to increase the functionality of non-threaded stripper rubbers.

It is another object of the present invention to reduce the number of specialized threaded stripper rubbers required at a drilling site.

Another object of the present invention is to allow larger drilling tools, downhole tools, and casing to pass through the attachment body and casing stripper.

Another object of the present invention is to maintain drilling fluids within the well.

Another object of the present invention is to create a safer work environment for rig personnel.

Another object of the present invention is to simplify the method of attaching and removing the casing stripper rubber.

Another object of the present invention is to allow a casing stripper rubber system that will save valuable time on the rig, thus reducing time in which the rig is inoperable.

In addition to the features and advantages of the casing stripper attachment according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
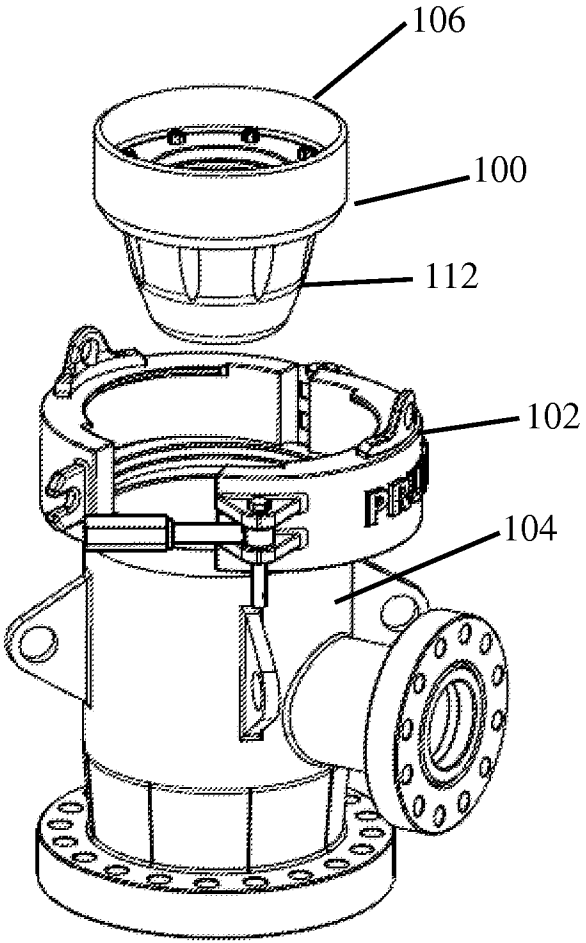
FIG. 1 is an environmental view showing one embodiment of the present invention.

Referring to FIG. 1, the attachment body of the present invention is generally illustrated by reference numeral 100. The attachment body 100 is characterized by an attachment lip 110 and base 106. The stripper rubber 112 attaches to the attachment lip 110 of the attachment body 100. After the stripper rubber 112 is attached to the attachment body 100, the attachment body 100 with stripper rubber 112 is installed within a housing 104 such as a bowl 104. The clamp 102 secures the attachment body 100 with the housing 104.

Continuing to refer to FIG. 1, the housing 104, a bowl in one embodiment, is installed on the drilling rig floor. The clamp 102 attaches attachment body 100 and casing stripper 112 to the housing 104 for use at the well. The base 106 has a diameter that is large enough to be secured within clamp 102. Continuing to refer to FIG. 1, attachment body 100 and casing stripper 112 may be removed from housing 104 and installed into housing 104. To install attachment body 100, the clamp 102 must be opened for insertion of attachment body 100. The user closes clamp 102 while the attachment body 100 is within clamp 102 to secure attachment body 100 and casing stripper 112 to the housing 104 as shown in FIG. 2.

Figure 2:
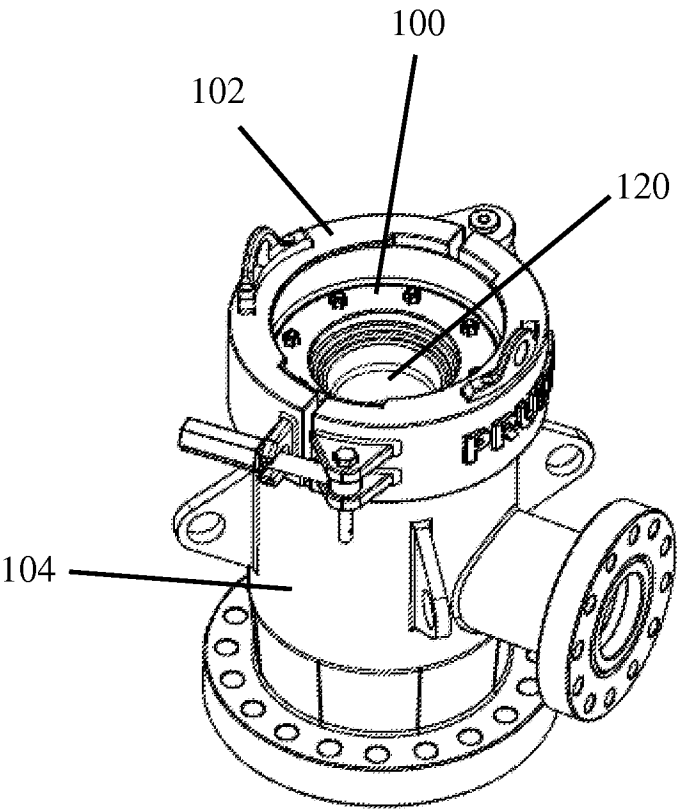
FIG. 2 is another environmental view thereof.

In FIG. 2, attachment body 100 and casing stripper 112 are secured with housing 104 for use at the well. FIG. 2 shows the attachment body 100 and casing stripper 112 installed into housing 104 for operation. The user inserts casing and other downhole tools into lip aperture 120 and stripper aperture 114 for use of the casing and other downhole tools in the well. The base 106 is sized such that the base 106 will fit within the housing 104. The base 106 and attachment body 100 are also sized such that the base 106 and attachment body 100 will be secured within the housing 104 and not pass completely through the housing 104.

Figure 3:
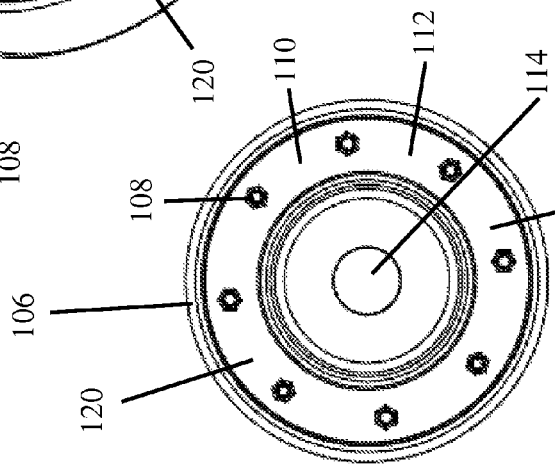
FIG. 3 is a top view of one embodiment of the present invention.

FIG. 3 shows a top view of the attachment body 100 with the casing stripper 112 installed on attachment body 100. Attachment lip 110 secures to base 106. In one embodiment, attachment lip 110 is welded to base 106. Attachment lip 110 provides a bottom surface 111 for attaching the casing stripper 112. The attachment lip 110 has an upper surface 109 and a lower surface 111. The casing stripper 112 attaches to the lower surface 111 of attachment lip 110. Fastener lock bodies 108, such as a nut, lock nut, or other locking body, secure the fastener 116. The lock bodies 108 contact the upper surface 109 of attachment lip 110.

When installing casing and/or other downhole equipment, the user inserts the casing and/or other downhole equipment through lip aperture 120 and stripper aperture 114. The bolted attachment of casing stripper 112 to attachment lip 110 provides a larger bore that allows casing and/or downhole equipment of a greater size than the known art.

The bolted attachment of casing stripper 112 improves upon previous connections of known casing strippers. The connections of known casing strippers require a threaded connection on the nipple. After use of the known casing strippers, the users cannot easily remove the known casing strippers from the nipple. Dirt and other debris interfere with the threaded connection thus increasing the difficulty in removing the casing stripper. Furthermore, the threads of the known casing strippers may be stripped through use of the known casing strippers. The users found it simpler to remove the known casing strippers by cutting or otherwise destroying the casing stripper to remove the casing stripper from the nipple.

Figure 4:
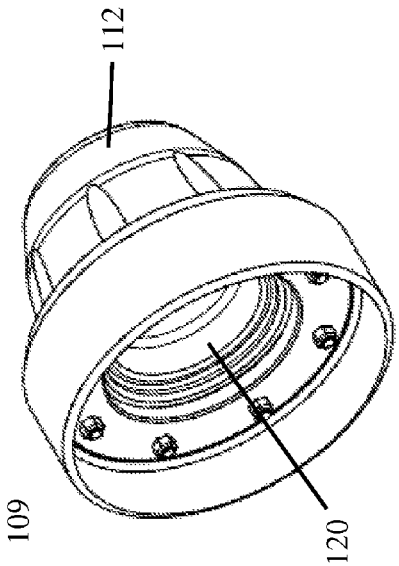
FIG. 4 is a top perspective view thereof.

FIG. 4 shows the lip aperture 120 in greater detail. Lip aperture 120 allows the casing and downhole equipment to pass through attachment body 100. In one embodiment, the base 106 attaches to the attachment lip 110 at weld 128. A person may weld attachment lip 110 to base 106 at weld 128.

Attachment lip 110 also provides a surface for attaching a pipe, such as a drilling nipple to the base 106. In one embodiment, a pipe, such as a drilling nipple, is welded to base 106 above the upper surface 109 of attachment lip 110. In one embodiment, the pipe is welded adjacently above the upper surface 109. The pipe extends upward above the casing stripper 112 and the attachment lip 110. The pipe may vary in height depending upon the particular drilling needs and the environment in which the casing stripper 112 is installed.

Figure 5:
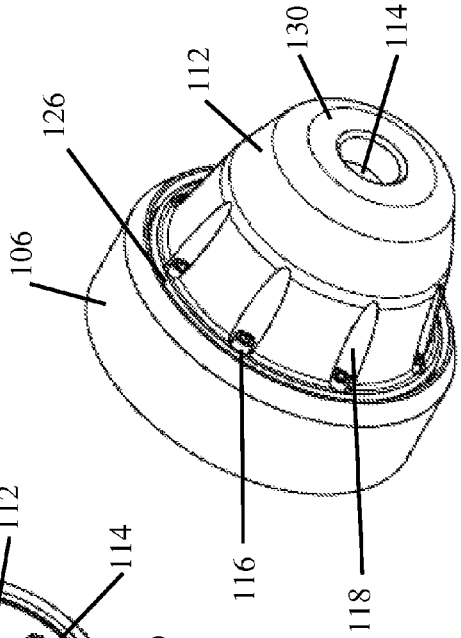
FIG. 5 is a bottom perspective view thereof.
Figure 7:
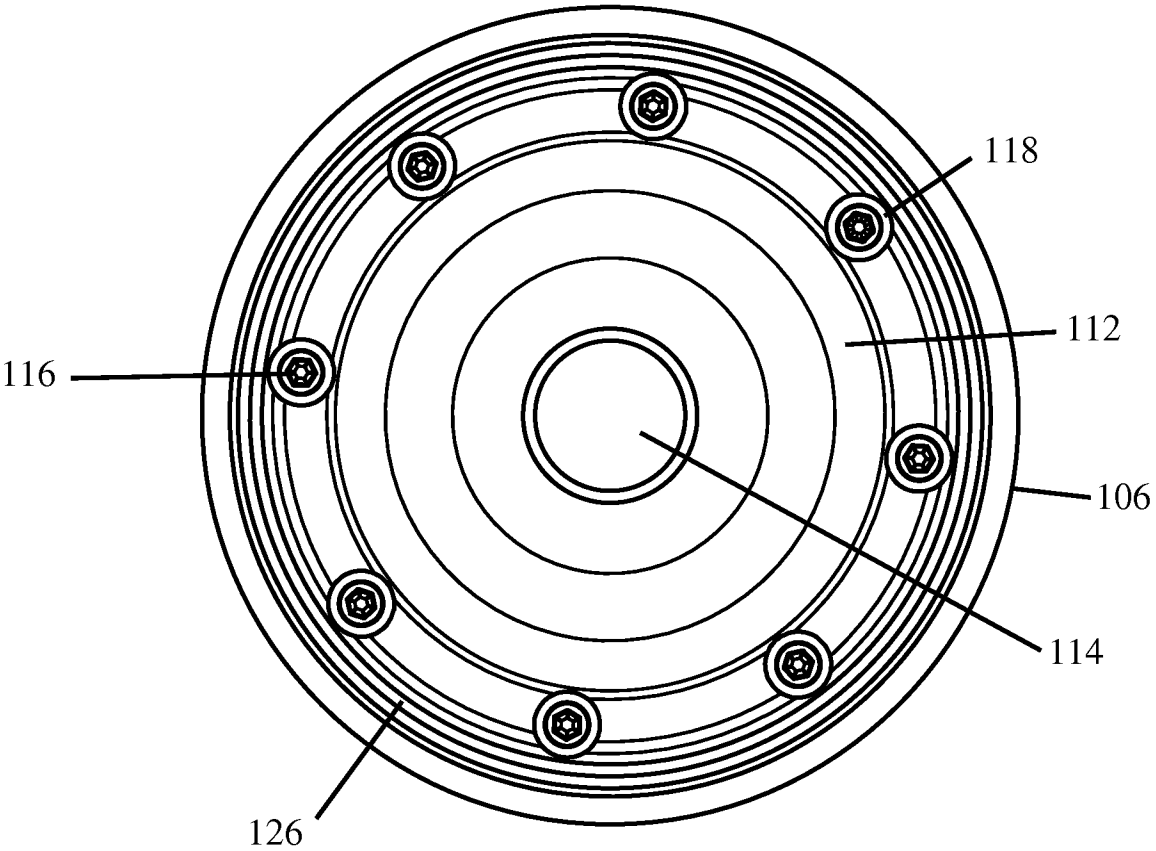
FIG. 7 is a bottom view thereof.

FIGS. 5 and 7 show bottom perspective views of the attachment body 100 secured to the casing stripper 112. Casing stripper 112 provides a fastening head 126. The top side of fastening head 126 contacts attachment lip 110. The bottom side of fastening head 126 contacts fasteners 116 for securing casing stripper 112 to attachment lip 110. The fastening head 126 extends outward from the casing stripper 112 to increase the size of the surface area of the casing stripper 112. The fastening head 126 increases the surface area of the casing stripper 112 for attaching the casing stripper 112 to the attachment lip 110. The fastening head 126 provides installation apertures 124 with sufficient surface for fasteners 116 to secure the casing stripper 112 to the attachment lip 110.

Figure 6:
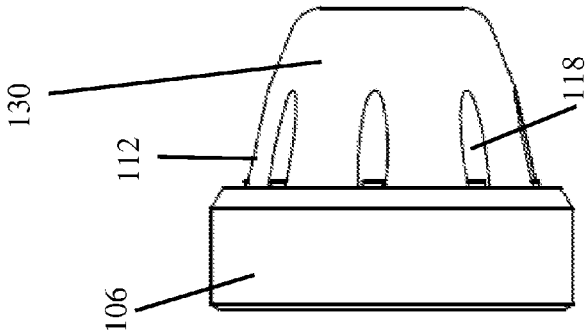
FIG. 6 is a side view thereof.

The casing stripper 112 also provides adjustment apertures 118 shown in FIGS. 5 and 6 for tightening and loosening fasteners 116 found on the bottom side of casing stripper 112. The fasteners 116 are inserted through installation apertures 122 of fastening lip 110 and installation apertures 124 of casing stripper 112. Nuts 108 or other locking bodies secure the fasteners 116 within the installation apertures to install casing stripper 112 to attachment lip 110. The nuts 108 of one embodiment of the present invention are found above the upper surface 109 of the attachment lip 110. In one embodiment, the nuts 108 are located adjacently above the upper surface 109 of the attachment lip 110.

Referring to FIGS. 5-8, the attachment of the casing stripper 112 to the base 106 will be discussed in greater detail. The casing stripper 112 provides a fastening head 126 that protrudes outward from the casing stripper 112. Fastening head 126 is placed adjacent the lower surface 111 of attachment lip 110. The fastening head 126 contacts lower surface 111 of attachment lip 110 when casing stripper 112 attaches to attachment lip 110. The installation apertures 124 of the fastening head 126 enables passage of fasteners 116 for securing the casing stripper 112 to the attachment lip 110.

In one embodiment of the present invention, the casing stripper 112 is a non-threaded rubber stripper that is attached to a rotating head. The present invention allows the non-threaded rubber stripper to be used in both the rotating head and the drilling nipple. Therefore, the present invention allows users to use a single type of rubber stripper thus eliminating the need for specialized threaded stripper rubbers. Users of the present invention may avoid purchasing and storing the threaded stripper rubbers. The present invention increases the use of the non-threaded stripper rubber to allow a user to function without the threaded stripper rubber. The user can then avoid purchasing and storing the threaded stripper rubber.

From the fastening head 126, the casing stripper 112 tapers to the stripper tail 130. The casing stripper 112 narrows from the fastening head 126 to the stripper tail 130. The casing stripper 112 contacts the casing as the casing is inserted through the stripper aperture 114 at stripper tail 130 of casing stripper 112.

Figure 8:
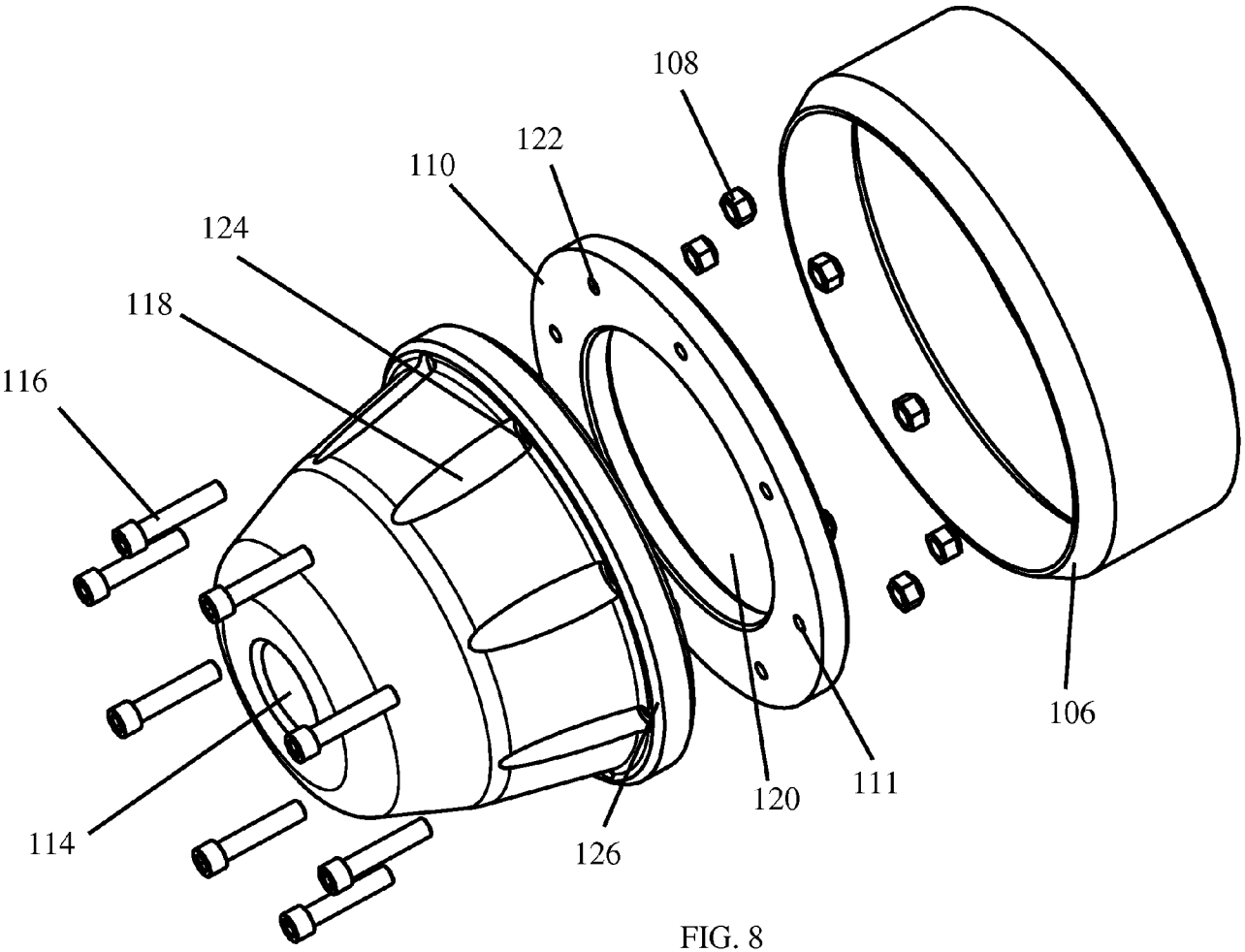
FIG. 8 is an exploded view thereof.

FIG. 8 shows an exploded view of the present invention. Fasteners 116 pass through adjustment aperture 118 and installation apertures 124 of casing stripper 112 and installation apertures 124 of attachment lip 110 to secure casing stripper 112 to attachment lip 110. Fasteners 118 enter from the bottom side of casing stripper 112 and attachment lip 110. Lock bodies 108, such as nuts 108, secure the casing stripper 112 to the attachment lip 110. In one embodiment, lock bodies 108 contact the upper surface 109 of attachment lip 110 to secure casing stripper 112 to attachment lip 110. Attachment lip 110 secures to base 106 by welding or some other attachment method.

Figure 9:
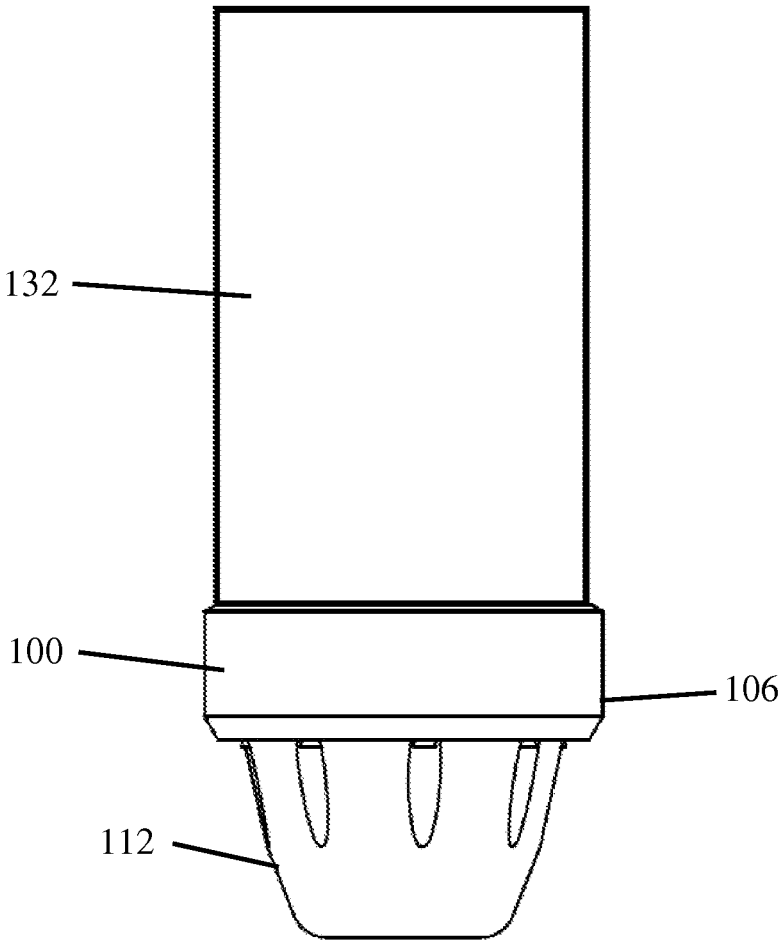
FIG. 9 is an environmental view of one embodiment of the present invention.

FIG. 9 shows an environmental view of the attachment body 100 secured with the casing stripper 112 and the pipe 132. In one embodiment, pipe 132 is a drilling nipple. The pipe 132 secures to the base 106 above the upper surface 109 of attachment lip 110. In one embodiment, pipe 132 is welded to the base 106. The pipe 132 varies in height according to the conditions of the well. The pipe provides an inner pipe aperture extending downwards to allow passage of casing and other downhole tools through the pipe 132, attachment body 100, and casing stripper 112. The inner surface of the pipe 132 defines the pipe aperture. In one embodiment, the inner surface of the pipe 132 is located horizontally outwards from the installation apertures 122 when the pipe 132 is attached to base 106.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An attachment assembly for securing a casing stripper within a bowl, a clamp securing the casing stripper within the bowl, the casing stripper configured to allow passage of the casing through the assembly and the casing stripper, the assembly comprising:

a base with an outer surface and an inner surface, the outer surface of the base sized to be secured within the clamp, the clamp securing the base within the bowl, the base sized not to pass completely through the bowl;

an attachment lip extending inward from the inner surface of the base, the attachment lip extending substantially perpendicularly inward from the inner surface of the base such that the attachment lip is approximately level;

a lip aperture providing a passageway through the attachment lip, the lip aperture located internally of the attachment lip and the base, the lip aperture providing access through the base and the attachment lip, the lip aperture sized to allow the casing to pass through the lip aperture;

an installation aperture of the attachment lip, the installation aperture configured to allow partial passage of a fastener through the installation aperture for securing the casing stripper to the base and the attachment lip; and a lower surface of the attachment lip contacting the casing stripper when the casing stripper attaches to the base, the lower surface providing a substantially planer surface for attachment of the casing stripper wherein the lower surface provides a substantially planar surface for attachment of the casing stripper to the attachment lip;

a fastener that attaches the casing stripper to the attachment lip;

at least one installation aperture of the attachment lip, the installation aperture enabling partial passage of the fastener through the attachment lip at installation aperture to secure the casing stripper to the attachment lip, the installation aperture located on the attachment lip in a nipple aperture of a drilling nipple.

2. The assembly of claim 1 further comprising:

a locking body configured to receive the fastener to attach the casing stripper to the attachment lip wherein the fastener is a threaded fastener.

3. The assembly of claim 2 further comprising:

the upper surface of the attachment lip contacting the locking body for securing the casing stripper to the attachment lip, the lower surface of the attachment lip providing a substantially planar surface for connecting the casing stripper to the attachment lip, the lower surface contacting the casing stripper, and the fastener partially passing through the installation aperture, the fastener entering the installation aperture from the lower surface.

4. The assembly of claim 3 further comprising:

at least eight installation apertures spaced circumferentially around the attachment lip, the eight installation apertures spaced approximately equal distances from each other.

* * * * *